US005899637A

United States Patent [19]

Blanchard et al.

[11] Patent Number: 5,899,637

[45] Date of Patent: May 4, 1999

[54] OFFSHORE PRODUCTION AND STORAGE FACILITY AND METHOD OF INSTALLING THE SAME

[75] Inventors: Conrad J. Blanchard, Belle Chasse; Frank L. Anastasio, Covington, both of La.

[73] Assignee: American Oilfield Divers, Inc., Houston, Tex.

[21] Appl. No.: 08/763,326

[22] Filed: Dec. 11, 1996

[51] Int. Cl.[6] ..... E02D 23/02; E02D 27/38

[52] U.S. Cl. ..... 405/210; 405/205; 114/257; 114/321

[58] Field of Search ..... 405/205, 210; 114/125, 312, 321, 256, 257

[56] References Cited

U.S. PATENT DOCUMENTS

| | | | |
|---|---|---|---|
| 2,383,840 | 8/1945 | Benckert | 405/210 X |
| 3,621,662 | 11/1971 | Starr et al. | 405/210 |
| 3,708,986 | 1/1973 | Roulet et al. | 405/210 |
| 3,855,809 | 12/1974 | Westling | 405/210 |
| 3,858,402 | 1/1975 | Baker et al. | 405/210 |
| 3,943,724 | 3/1976 | Banzoli et al. | 405/210 |
| 3,961,488 | 6/1976 | Ovsttun | 405/210 |

(List continued on next page.)

OTHER PUBLICATIONS

J. E. Hunteman, et al., "Concrete Gravity Platform in Shallow Offshore Louisiana Water," paper presented at the 11th Annual Offshore Technology Conference, Houston, Texas, Apr. 30–May 3, 1979.

F. L. Anastasia, Jr., "Concrete Tank, Steel Platform Marriage Sets Development Scheme," *Offshore*, Dec. 1991, pp. 47–48.

C. Blanchard, conceptual proposal in letter of Nov. 2, 1995 and accompanying sketch.

"Hard Times Spawn Improved Technology," *World Oil*, Jul. 1986, p. 35.

F. L. Anastasio, Jr., "Concrete–Steel Platforms Offer Shallow Water Option," *Ocean Industry*, May 1989.

Flier: "Typical Compartmentation of Gravity Structure," Productin Management Structral Systems, Inc., New Orleans, Louisiana.

Flier: "Concrete Underwater Storage Tank/Production," Production Management Structural Systems, Inc., New Orleans, Louisiana.

*Primary Examiner*—Tamara L. Graysay
*Assistant Examiner*—Tara L. Mayo
*Attorney, Agent, or Firm*—Browning Bushman

[57] ABSTRACT

A concrete barge having oil storage tanks secured to its deck is towed to an oil production site where it is sunk to the sea bottom. Oil from an adjacent caisson supported production facility is temporarily stored in the tanks pending later transfer to an oil tanker. The caisson may be braced from the barge in hard-bottomed locations or may be guyed to the sea floor. Compartments in the concrete barge are filled with water as required for ballast and trim while the barged is being towed to location. The compartments are flooded with seawater to provide the sinking force to carry the barge and tank assembly to the sea bottom and hold the assembly on the sea bottom. Descent of the barge from the surface to the sea bottom is regulated by controlling the placement and pressure of air in the storage tanks. The submerged barge and tanks are filled with seawater to prevent hydrostatically induced crushing pressure differentials. Oil added to the tanks from the production facility displaces an equal volume of seawater from the tanks to ensure that the tanks remain constantly filled with a fluid. Oil is displaced from the tanks to the tanker by the introduction of seawater into the tank bottoms. The outlet from the tanks is taken from the tank tops so that the lighter oil is discharged into the sales lines as the heavier water occupies an increasing volume in the lower level of the tank. The tanks are coated in concrete to increase their collapse resistance.

15 Claims, 5 Drawing Sheets

U.S. PATENT DOCUMENTS

| | | | |
|---|---|---|---|
| 4,161,376 | 7/1979 | Armstong | 405/196 |
| 4,195,951 | 4/1980 | Finsterwalder | 405/210 |
| 4,200,411 | 4/1980 | Brown et al. | 405/210 |
| 4,230,422 | 10/1980 | Brown et al. | 405/210 |
| 4,854,778 | 8/1989 | Valenzuela | 405/204 |
| 4,907,912 | 3/1990 | Smith | 405/210 X |
| 5,074,715 | 12/1991 | Vigander | 405/210 |
| 5,354,151 | 10/1994 | Giannesini | 405/210 X |

FIG. 5
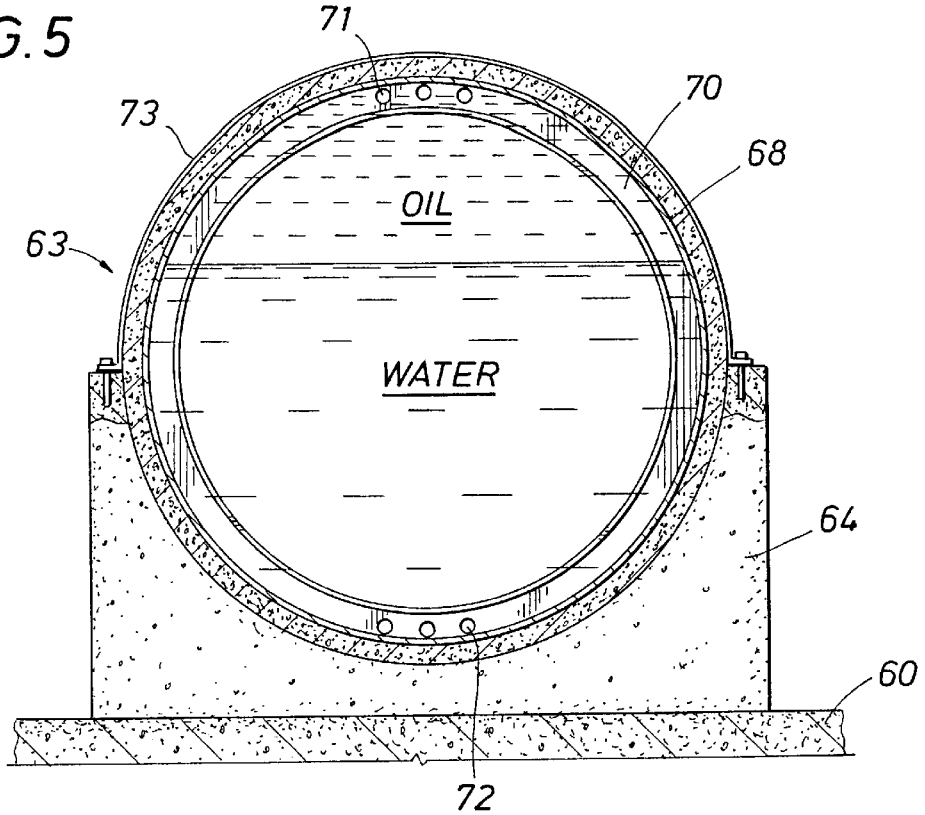
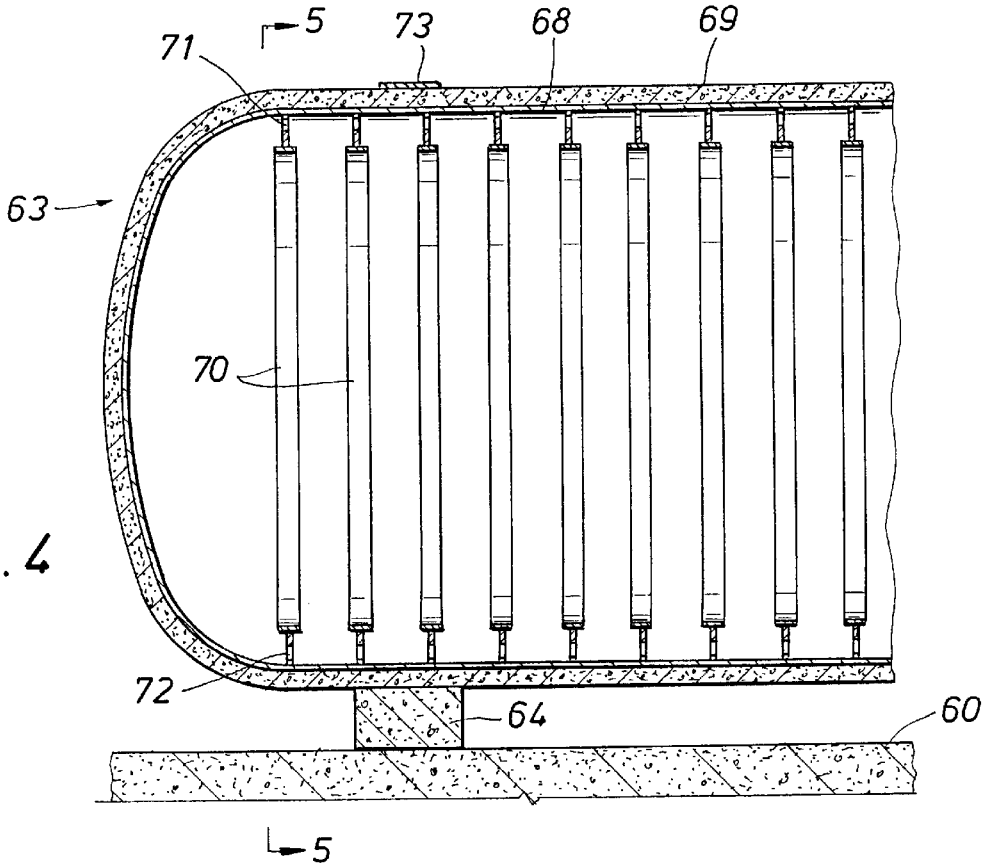
FIG. 4

FIG. 6
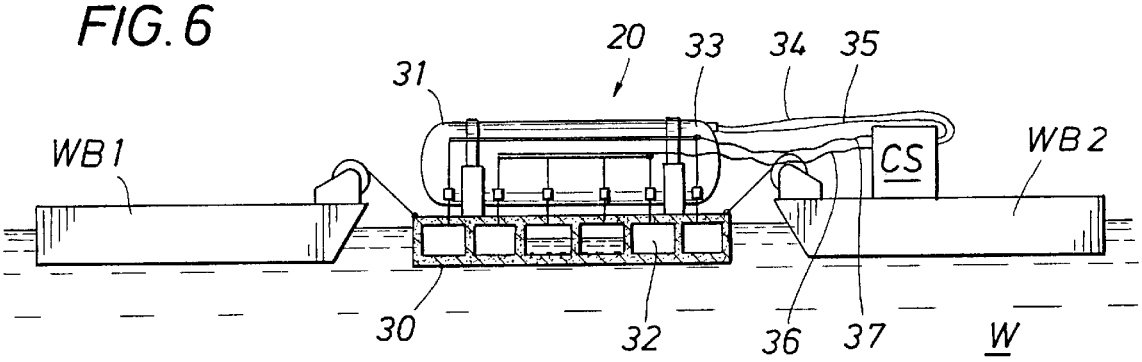
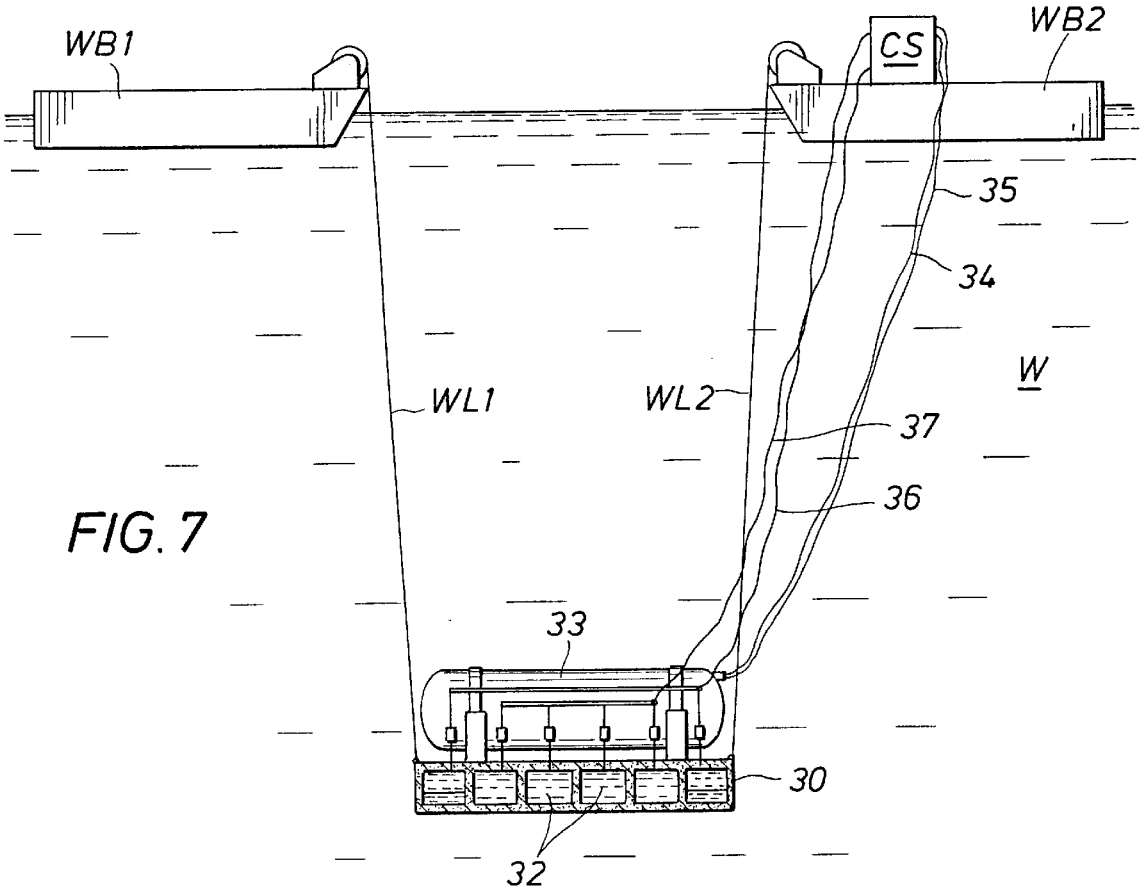
FIG. 7
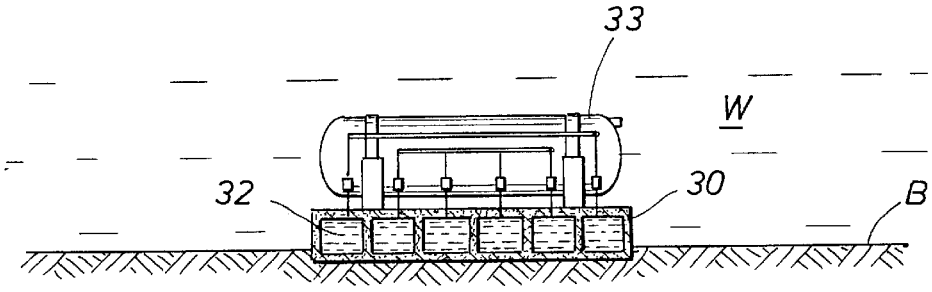
FIG. 8

OFFSHORE PRODUCTION AND STORAGE FACILITY AND METHOD OF INSTALLING THE SAME

BACKGROUND OF THE INVENTION

1. Field of the Invention

The present invention relates to the storage of well fluids produced from offshore wells. More specifically, the present invention relates to a submergible storage system for the temporary storage of oil produced from wells completed in deep, remote offshore locations.

2. Description of the Prior Art

Oil and gas produced from offshore wells must be transported from the site of the well to a land-based, refining, storage, or transportation facility for subsequent processing and dispersement to the end users. In most situations, such production fluids are transported either via a submerged pipeline or by a tanker from temporary storage facilities located at the well site. In some cases, a large production facility may process the well fluids before they are transported by the tanker or pipeline to the final user.

Typically, the economies of building and operating an offshore production facility require that a large number of wells, or a few very prolific wells, be in the near vicinity of the facility and connect to the facility by submerged pipeline. Similarly, the cost of laying a pipeline to an offshore production area is justified only if there is a relatively large number of wells in the offshore area and they are not too distant from an onshore facility.

In many cases, where the amount of oil produced is limited, the cost of providing a pipeline or an intermediate production facility for the temporary storage of oil produced from a single well or an isolated field cannot be justified. In such situations, the use of tankers to collect oil from temporary storage facilities at the remote well or field may be the only practical way to secure the production from these isolated or minimally producing wells.

The temporary storage of oil and other fluids produced from some wells has, in the past, been accomplished by constructing a production platform with storage facilities at the site of the well and off-loading the stored fluid periodically into a tanker. Additionally, in some cases, underwater storage tanks or facilities have been employed to store production from these wells. In either case, these prior art methods for temporary storage of the well fluids have been employed in relatively shallow water, where the cost of erecting a platform or placing an underwater storage tank is reasonably in proportion to the value of the hydrocarbon product being produced at the remote site. As the water depth increases, the cost of production platforms or submerged storage facilities increases accordingly and, in deeper water, use of such systems has not proven economical.

In some areas, even in relatively shallow water, and even where production gathering facilities are close enough to be connected by a relatively short submerged pipeline, the cost of building a conventional production platform cannot be justified based on the amount of production anticipated from the well. Accordingly, there is a class of wells that could be economically drilled and produced if the cost of fabricating a suitable production platform were economical. In such cases, the addition to the site of adequate temporary surface storage or, even submerged temporary storage, can make production from the site economically desirable.

Oil and gas have been economically produced from marginally producing wells located in relatively shallow, accessible locations where the production platform can be of a caisson-supported design, which is significantly less costly than a typical production facility. An example of an economical, caisson-mounted production system is described in U.S. patent application Ser. No. 08/573,594, assigned to the assignee of the present invention. In the described caisson production completion system, the production platform is supported by a single caisson that eliminates the need for a multi-leg platform that is anchored into the water bottom. The savings realized from completing the well with a caisson system as described in the patent application can make a marginal well economically profitable.

BRIEF DESCRIPTION OF THE INVENTION

The present invention provides an offshore production and storage facility that may be economically employed in deep water and remote offshore locations. A production facility, e.g., a single caisson-type, is employed in combination with a submerged temporary storage system that permits the fluid production from the well to be temporarily stored and periodically transferred to a tanker for transport to a land-based facility. One or more wells are drilled at the offshore site using either a conventional jack-up rig or another suitable drilling rig. The well is completed using a suitable production platform. Fluids produced from the well are temporarily stored in a submerged tank system from which the fluids are periodically transferred to a tanker for transport to the land-based processing or distribution facility.

The oil storage system is comprised of a series of steel tanks that are secured to the deck of a submergible concrete barge. The flat-bottomed, concrete barge is compartmentalized to receive and distribute seawater into different compartments as required to ballast and trim the barge as it is being towed from the place of its construction to the offshore well site. Multiple steel tanks strapped to the deck of the barge are coated with concrete to protect them from the pressure differentials produced during the process of submerging and retrieving the storage tanks.

At the well site, the barge compartments are filled with seawater and equalized to corresponding sea pressure. The air content of the tanks is regulated by surface vessels employed in the placement of the barge. Sufficient water is added to the concrete-coated storage tanks. As the assembly is submerged, the tanks are supplied with sufficient pressurized air to prevent crushing pressure differentials from developing across the tank walls while simultaneously regulating the buoyancy of the assembly as it is submerged so as not to exceed the weightlifting capacities of the positioning vessels.

At rest on the sea bottom, the tanks of the barge are connected to the flow lines from the production or gathering facility and to the off-loading, or "sales," lines that connect with a surface buoy for access by the oil tanker. Water is pumped from a flowline extending from the surface to the barge into the tanks. Air pressure is released from the tanks as the tanks and flowline fill with water. Pressure release is controlled by a control system (CS) to maintain external and internal pressure of the tanks at equilibrium. In operation, fluids produced from the well are supplied to the tanks while an equal volume of seawater is simultaneously displaced from the tanks and flows through the flowline to be processed at the surface. The hydrocarbon fluids produced from the well are lighter than seawater and rise to the top of the tanks. This automatically offsets the volume of oil added to the tank top. Maintaining the tanks full of liquid at all times prevents the development of destructive pressure differentials that would crush the tanks under the hydrostatic pressure of the seawater.

Removal of oil from the tanks is accomplished by the addition of seawater to the tank bottoms, which displaces oil from the top of the tanks into the off-loading sales line extending to the surface tanker.

In some applications, the caisson may employ the barge as an additional structural support. This feature is particularly advantageous where the sea bottom is hard, making it difficult to set anchors from which the caisson may be guyed. Where the caisson may be easily guyed, the storage barge may rest adjacent to the caisson base and function independently of structural connection with the caisson.

The steel tanks forming the storage chambers for the well fluids are internally braced to further improve their crush resistance. The internal braces are laterally ported at their upper and lower extremes to permit the lateral transfer of fluids as may be required to completely disperse water or oil from the tank by the introduction of a displacing fluid.

When the production from the well or wells drops to a point that production is no longer economic or when the well or wells are to be shut in for other reasons, the temporary storage assembly can be retrieved and moved to be used at another location. Retrieval of the storage barge from the sea bottom is effected by pumping air into the storage tanks to displace water and buoy the assembly to the surface. At the surface, the tanks may be completely emptied and the barge chambers partially evacuated of water to re-ballast and trim the barge for towing to the new location.

From the foregoing, it will be appreciated that a primary object of the present invention is to provide a portable, offshore production and storage facility that may be employed to temporarily store the fluid production from a production or gathering facility in deep water.

Another object of the present invention is to provide a submergible fluid storage facility that can be employed in combination with a caisson-type well completion to provide structural support for the caisson in a deep-water, hard-bottomed location.

Another important object of the present invention is to provide a storage facility that may be controllably positioned and retrieved in deep water and that may be employed to temporarily store the production of fluids from a well in relatively deep water.

An important object of the present invention is to provide a pressure-resistant, submergible storage facility that can be employed in deep waters while resisting the high hydrostatic crushing pressures present in such sites.

Another object of the present invention is to provide a pressure-resistant tank that includes a concrete coating to provide increased resistance to pressure-induced crushing forces by employing the concrete coating to protect the underlying steel body of the storage tank.

Still another object of the present invention is to provide a submergible, temporary oil storage system that may be refloated and moved to serve as a temporary oil storage system at another offshore location.

The foregoing objects, features, and advantages of the present invention will be more fully appreciated and understood by reference to the following drawings, specification, and claims.

BRIEF DESCRIPTION OF THE DRAWINGS

FIG. 4 is a cross-sectional view taken along the line 4—4 of FIG. 3 illustrating details in the construction of a tank employed in the production facility of the present invention;

FIG. 5 is a vertical cross-sectional view taken along the line 5—5 of FIG. 4 illustrating additional details in the construction of a tank employed in the production facility of the present invention;

FIG. 6 is an illustration, partially in vertical section, depicting the initial lowering of the submergible storage facility of the present invention;

FIG. 7 is a view similar to FIG. 6 illustrating the storage facility partially submerged; and FIG. 8 is a view similar to FIGS. 6 and 7 illustrating the storage facility resting on the sea bottom in preparation for receiving production fluids from an associated well.

DESCRIPTION OF THE PREFERRED EMBODIMENTS

Figure 1:
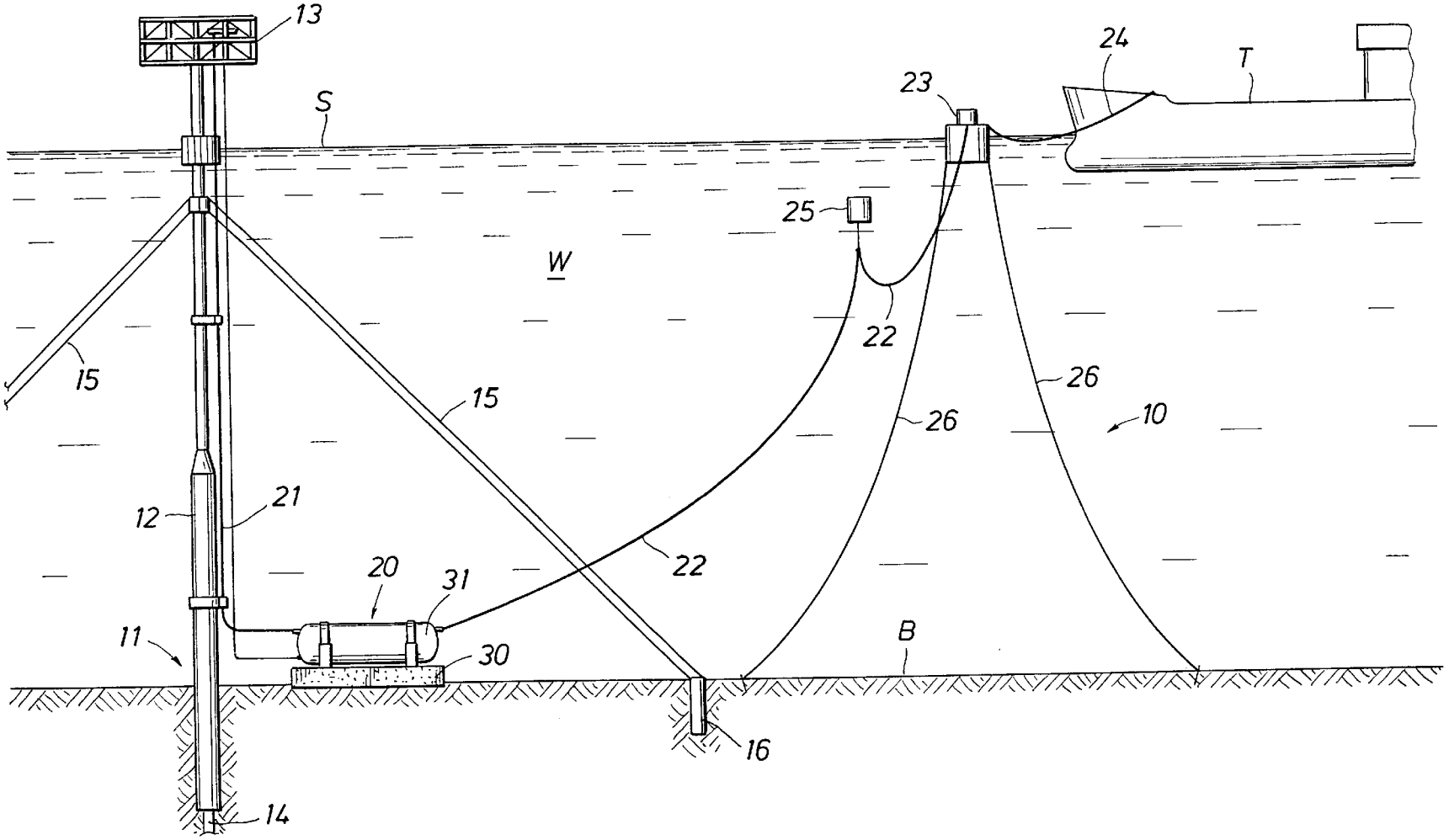
FIG. 1 is a sectional elevation illustrating an offshore production and storage facility constructed in accordance with the teachings of the present invention.

The offshore production and storage facility of the present invention is indicated generally at 10 in FIG. 1 of the drawings. The facility 10 includes an oil well, indicated generally at 11, that employs a caisson 12 to support a small surface production platform 13 extending above the surface S of a body of water W. In a typical installation, a well casing 14 extends through the caisson 12 to the production platform 13 where production casing and tubing in the well are connected to a wellhead (not illustrated). Guy lines 15 extending between the caisson 12 and embedded anchors 16 positioned in the bottom B of the water body are employed to maintain the caisson erect. In a conventional installation, three guy lines 15 are disposed at 120° spacings from each other about the base of the caisson 12.

Where conditions of the bottom permit, the caisson 12 and the anchors 16 are driven into the water bottom B by a surface-operated pile driving device. Bottoms that are too hard to be sufficiently penetrated by pile-driven structures may be drilled to receive the caisson and anchors.

Depending on the requirements of the site, the caisson may be placed in position by the rig that also drills the well 11 or may be placed in position before or after the well is drilled using appropriate installation vessels.

Oil produced from the well 11 is supplied to a submerged storage facility of the present invention, indicated generally at 20, by a flow line 21 that extends from the surface platform 13 alongside the caisson 12.

Oil temporarily stored in the storage facility 20 is periodically removed by a sales line 22 to a surface oil tanker T. The sales line 22 extends to a surface floating, off-loading buoy 23. An off-loading line 24 that communicates with the sales line 22 extends from the tanker to the buoy 23. A submerged buoy 25 supports the submerged line 22 at an intermediate point along the line length to isolate the floating buoy 23 from the weight of the line 22 so that the buoy remains stable during the process of conveying the oil from the facility 20 to the tanker T. Steel guy lines 26 anchored to the water bottom B hold the floating buoy 23 in a fixed position relative to the well 11.

In operation, oil produced from the well 11 flows through the line 21 into the temporary storage provided by the facility 20. On a regular basis, determined by the amount of fluid being produced from the well 11, the tanker T sails to the well site and connects its off-loading line 24 to the appropriate connection on the floating buoy 23 to convey fluid from the storage facility to the hold of the tanker. The oil taken on by the tanker from the storage facility 20 is transported by the tanker to a remote processing or distribution facility.

FIGS. 6, 7, and 8 illustrate steps in the positioning of the storage facility 20. The facility 20 is constructed in two major components comprising a flat-bottomed barge section 30 and a storage tank section 31. The barge section 30, constructed of steel-reinforced concrete, is provided with a series of interconnected hollow chambers 32 that extend from the barge bottom to the barge deck and are distributed throughout the barge body. The size and placement of the chambers within the barge are selected as required for the barge size and its towing, sinking, and support requirements. Suitable valve and flow line connections (not illustrated) interconnect the chambers 32. The valves and flow lines are controlled to selectively fill or evacuate the chambers 32 as required to properly ballast and trim the assembly 20 while it is under tow. The chambers 32 are completely filled with water when the assembly is being prepared to be submerged to its position on the water bottom B. The tank section 31 of the assembly 20 is comprised of a number of concrete-encased steel tanks 33 that are also interconnected by flow lines and control valves and are employed to temporarily store the fluid produced from the well.

When the facility 20 has been towed into its installation site above the waterbed B, two winch boats WB1 and WB2 are positioned on either side of the facility 20 and secured to the facility with appropriate winch lines WL1 and WL2. A control system CS on the winch boat WB2 connects via flexible control lines 34 and 35 with the concrete-encased steel tanks 33 to control the liquid level and air pressure within the tanks during the submerging procedure. Flexible control lines 36 and 37 connect the control system CS to the barge compartments 32 to control the fluid level in the compartments.

The storage facility 20 is initially submerged by operating the control system CS to open air release valves (not illustrated) connected with the tops of the chambers 32. The control system CS simultaneously opens fluid inlet lines (not illustrated) opening into the base of the chambers 32 to fill the chambers with seawater. Water entering the chambers 32 displaces the air so that the chambers 32 are completely filled with water.

The air supply valve openings and the water line openings to all of the chambers are left open during the subsequent submerging process to ballast the facility 20 and to prevent the development of any pressure differential across the walls of the chambers 32 as the assembly 20 is submerged. During the initial stages of sinking the barge 30, the barge chambers 32 may be selectively filled or partially filled with water to maintain control of the descending assembly 20. In a preferred embodiment, the buoyancy of the tanks 33, when empty, is such that the assembly 20 remains buoyant when the chambers 32 of the barge 30 are completely filled with water. Subsequent submerging of the assembly 20 is accomplished by allowing water to enter the tanks 33 in sufficient amounts to increase the weight of the system 20 and overcome the buoyancy of the remaining air in the tanks.

With the assembly 20 fully submerged, the preferred procedure for lowering the assembly to the water bottom is to maintain a volume of water in the tanks 33 that will be sufficient to cause the assembly to sink under the effects of gravity but that does not make the assembly so heavy that it exceeds the retaining or holding power of the winches or winch lines WL1 and WL2 on the winch boats. As the assembly 20 is lowered into the water and is thus exposed to increasing hydrostatic pressures, the control system CS is employed to supply pressurized air to the tanks 33 via the lines 34 and 35 to substantially equal that of the increasing hydrostatic pressure so that no resulting crushing pressure differential is developed across the walls of the tanks. During this lowering process, the volume of liquid in the tanks may be shifted as required to maintain stability and proper orientation of the assembly 20.

Once the storage facility 20 is at rest on the water bottom B, the tanks will be completely flooded with water so that all remaining air is displaced from the tanks. When it is desired to store produced fluids, they are introduced into the tanks, an equal volume of seawater being simultaneously displaced from the tanks through the flowline to the processing facility located on the platform 13 so that any oil can be removed from the displaced water and the water can be safely discharged overboard into the sea.

Figure 2:
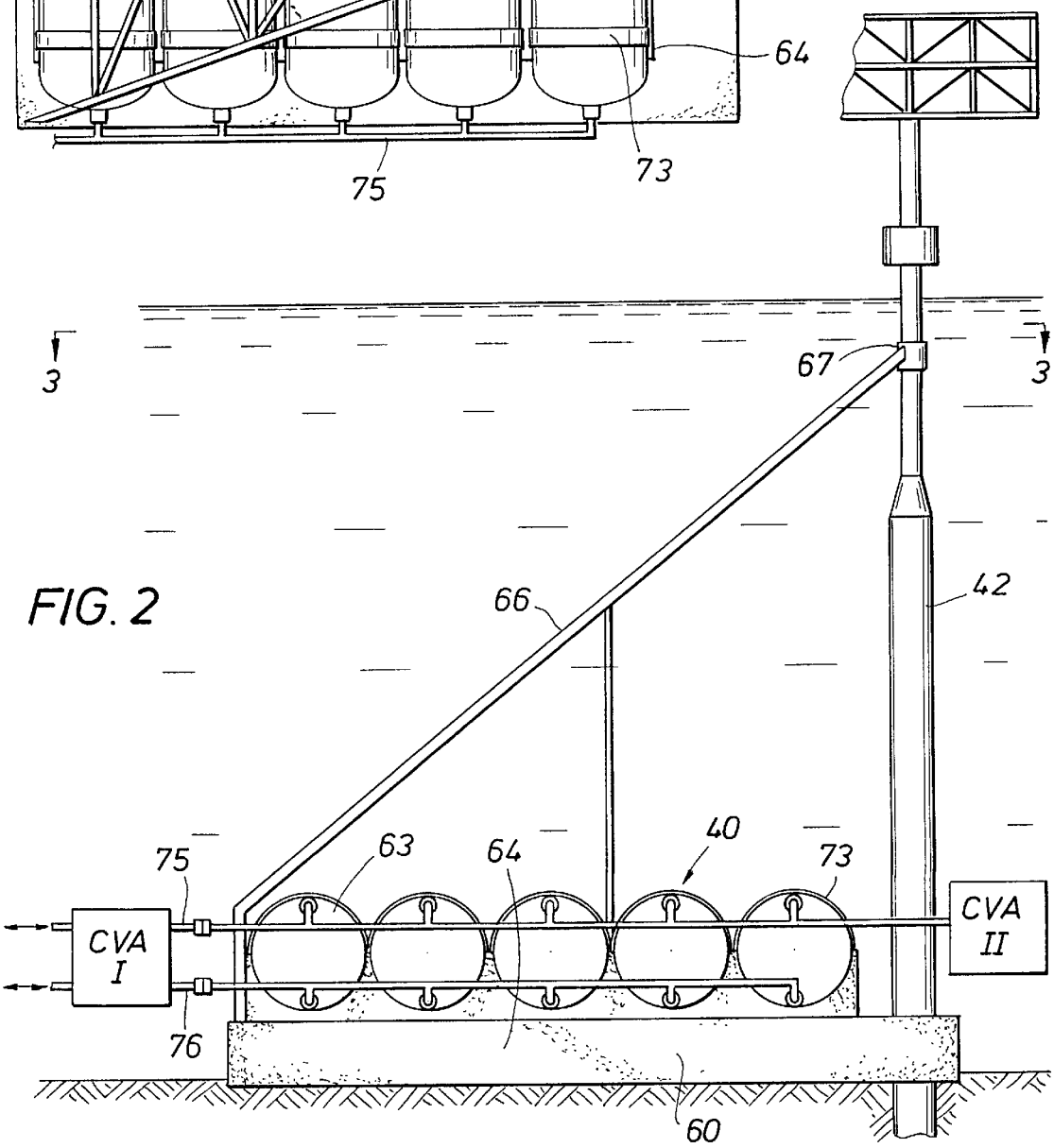
FIG. 2 is a sectional elevation illustrating a modified form of the submerged production facility of the present invention wherein the facility provides structural support for a caisson-type well completion.

FIGS. 2–5 illustrate details in the construction and operation of an embodiment of the invention in which a storage facility indicated generally at 40 in FIG. 2 cooperates with the caisson 42 to provide vertical support for an unguyed installation. As may best be seen by joint reference to FIGS. 2 and 3, the storage facility 40, which is similar to the facility 20, includes a concrete barge section 60 that carries a series of five tanks, such as the tank 63. The tanks are positioned in curved recessive groups in a horizontally extending cradle structure 64 that is preferably formed integrally as a part of the barge section 60. A key slot 65 recessed at one end of the barge 60 is positioned about the caisson 42. A triangular, cross-trussed brace 66 extends from the far end of the barge 60 upwardly to an intermediate attachment point 67 on the caisson 42. The brace cooperates with the caisson 42 to provide a broad base structure that maintains the caisson in its vertically erect position.

FIGS. 4 and 5 illustrate details in the construction of the tanks 63 employed in the storage facility of the present invention. The tanks 63 are preferably formed of cylindrical steel tanks 68 having hemispherical end closures. A layer of concrete 69 encases the steel tanks 68 to increase the resistance of the tanks to the effects of high hydrostatic pressures acting across the tank walls. Additionally, the concrete provides an effective corrosion and erosion barrier for the external tank surface. The internal areas of the tank are additionally reinforced by annular, T-section cross braces 70. The vertically uppermost sections of the braces are laterally ported with openings 71. Similar openings 72 are provided at the vertically lowermost section of the braces within the tank. The ports 71 and 72 allow the fluids on either side of the braces 70 to flow laterally past the brace as the tanks are being filled or emptied.

Each of the tanks 63 is held to the cradle structure 64 by steel straps 73 extending over each end of the tanks and anchoring to the cradle structure.

As previously noted, in operation as a storage facility, the tanks 63 will contain a combination of liquids, typically oil and water. Oil, being less dense than water, will rise above the water within the tank 63, as illustrated in FIG. 5. Flow lines 75, manifolded as illustrated in FIG. 2 and connected to the upper internal area of the tanks, are employed to add or withdraw fluid from the upper portion of the tank. Similar flow lines 76 manifolded and connected into the lower portion of the tanks remove fluid from the tank bottoms. In a typical application, with the lighter oil at the top of the tanks, the lines 75 will be in communication with oil while the lines 76 will communicate with the water below the oil. When the tanks are full of oil, it will be understood that the lines 76 will also be in communication with oil.

In the operation of the system illustrated in FIG. 2 connected to a surface off-loading buoy in the manner illustrated in FIG. 1, oil produced from the well associated with the caisson structure 42 will be supplied to the tanks 63 through a control valve assembly CVA. While the control valve system CVS has been depicted schematically as a single control facility, it will be appreciated that the system employs remotely operated valves at each appropriate access and exit point for controlling the flow of fluids through the facility 40 and also includes transducers for monitoring and recording such variables as pressure, liquid level, liquid interface, temperature, flow rates, fluid density, etc. The construction and operation of control valve systems for suitably monitoring and controlling the operation of the facility 40 are well known in the art and are not, per se, a novel feature of the present invention.

As the oil is added to the tanks 63, the lines 76 are opened by the control valve assembly CVA to permit the water in the bottom of the tanks to be displaced to accommodate the in-flowing oil. As noted above, this displaced water is treated to remove any oil and then discharged back into the sea. During this procedure, the tanks 63 are constantly filled with liquid so that there are no gas voids within the tanks. The liquid in the tanks will typically be a layered volume of oil and water, all oil, or all water. In removing the oil from the tanks and sending it to the tanker, the control valve assembly CVA is manipulated to add water to the tanks through the line 76 while displacing the oil from the tanks through the lines 75 and up to the surface oil floating buoy and to the tanker.

In a preferred embodiment of the offshore production and storage facility of the present invention, the facility is designed to be deployed and operated in waters exceeding 100 feet in depth. The barge and tank of the assembly 20 or 40 may have a combined empty weight of approximately 30,000 tons in a system intended to store 150,000 or more barrels of oil. Each tank 63 in such a system has a diameter of approximately 40 feet and is approximately 138 feet long. It will be appreciated that larger or smaller volume barges and tanks can be employed. Further, a plurality of barge/tank systems can be used, lashed together and with interconnecting flowlines between the individual barge/tank systems, if desired.

Figure 3:
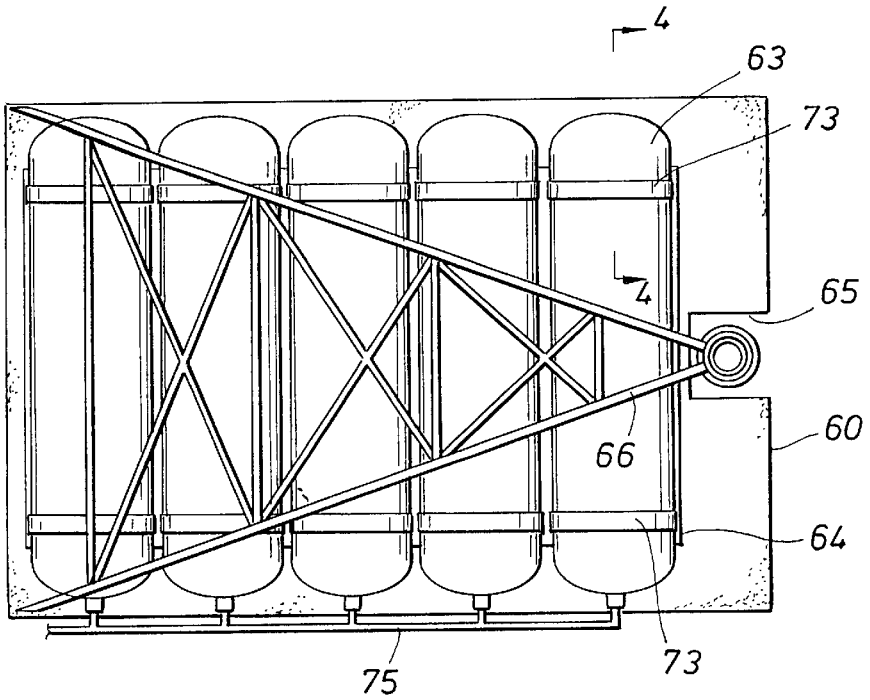
FIG. 3 is an overhead view taken along the line 3—3 of FIG. 2 illustrating the tanks secured to the barge of the present invention.

In the system illustrated in FIGS. 2 and 3, the caisson 42 and triangular brace 66 may be towed to location as a part of the assembly 40. During towing, the caisson may either be erect or may be rested horizontally on the barge and be erected either before or after the barge is submerged. The type installation illustrated in FIGS. 2 and 3 would be desirable, for example, where the assemblies 40 and 42 are to be erected over a previously drilled well in an environment having a hard water bottom such that pile driving is undesirable.

It will be appreciated that the facilities 20 and 40 are essentially identical in operation and construction except insofar as the facility 40 is designed to provide the structural bracing for an associated caisson.

Figure 9:
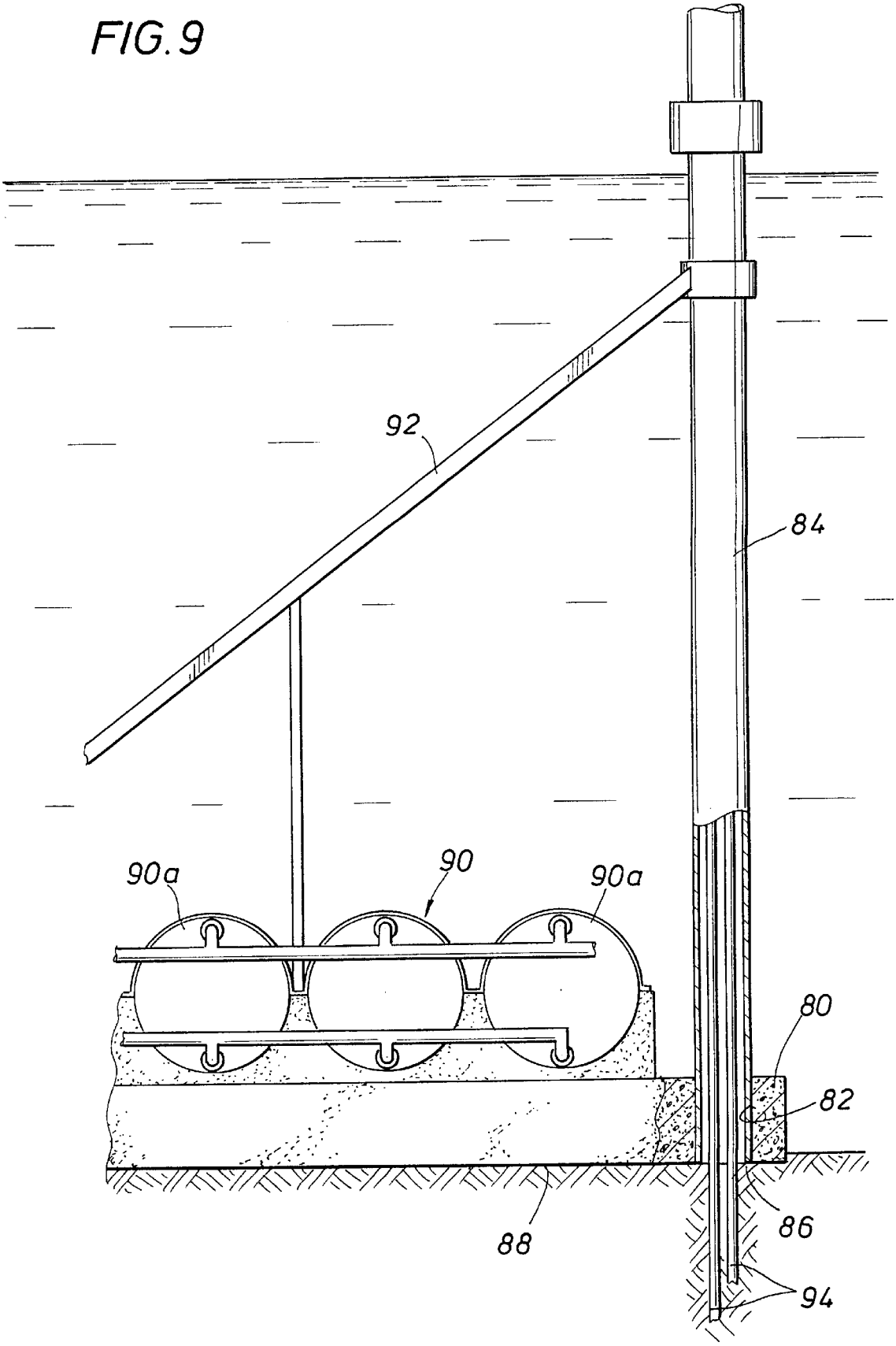
FIG. 9 is a partial, elevational view showing another embodiment of the facility of the present invention.

In FIG. 9 there is shown a modified embodiment of the storage facility of the present invention wherein the caisson and attendant support bracing is formed integrally with the barge. With reference then to FIG. 9, the barge section 80 has an opening 82 through which the caisson 84 extends and is secured to barge 80. The lower end 86 of caisson 84 terminates at the lower surface 88 of barge 82. The concrete-lined storage tank array, shown generally as 90, is mounted to barge 80 in the manner described above. Caisson 84 is further stabilized and secured to barge 80 by a triangular, cross-trussed brace 92, rigidly interconnecting caisson 84 and barge 80. As shown, extending through caisson 84 is production tubing 94, which extends down into a producing formation in a manner well known, produced fluids from the formation flowing up through tubing members 94 to be gathered at the surface as described above. The embodiment shown in FIG. 9 has the advantage that since the caisson 84 is integral with barge 80, the system can be positioned at a desired location, barge 80 with tank system 90 lowered to the seabed as described above, after which all operations, e.g., drilling, completing, and producing, can be conducted through caisson 84 from a suitable platform (not shown). In a sense, the embodiment of the system shown in FIG. 9 provides a combined drilling, producing, and storage facility for retrieving oil from subsea formations. As noted, ballasting of barge 80, pressurization of tanks 90*a* to prevent collapse, and transfer of produced fluids to and from tanks 90*a* would all be conducted as described above with respect to the other embodiments.

It will also be appreciated that while the flow lines and sales lines have been referred to as single lines, these lines may in fact be bundles of flow and control lines that are operated in a conventional manner to regulate the transfer of fluids to and from the tanks. It will also be understood that while the system has been shown with a single caisson installation, a single storage facility may in fact be connected with several caisson-type completions in the near vicinity of the storage facility.

Accordingly, while a preferred form of the invention has been illustrated and described, it will be appreciated by those having ordinary skill in the art that various modifications in the details of the construction and operation of the system may be made without departing from the spirit and scope of the present invention.

What is claimed is:

1. A system for temporarily storing liquids produced from an offshore well, comprising:

a submergible barge;

a storage tank connected with said barge to form a storage assembly, said storage tank having an upper internal storage area and a lower internal storage area;

a supply line for supplying liquid to said storage tank;

a sales line for removing liquid from said upper internal storage area of said storage tank;

a control valve system for controlling the flow of fluids into and out of said storage tank whereby fluid removed from said storage tank by said sales line is replaced by fluid added through said supply line to maintain said storage tank filled with fluid; and a caisson well completion having the fluid produced from said well completion connected through said supply line to said storage tank, said caisson well completion being at least partially supported by said barge.

2. The system as defined in claim 1, further comprising an access buoy assembly for establishing a connection between said sales line and the on-loading line of a tanker ship.

3. The system as defined in claim 1 wherein said barge is constructed of concrete.

4. The system as defined in claim 1 wherein said barge is equipped with multiple compartments that may be selectively filled with water for ballasting said barge.

5. The system as defined in claim 1 wherein said tank comprises a steel body encased in concrete.

6. The system is defined in claim 1, further comprising a plurality of interconnected storage tanks mounted on said barge.

7. The system as defined in claim 6 wherein said barge is constructed of concrete and said tanks are encased in concrete.

8. The system as defined in claim 7 wherein said storage assembly is submerged and said tanks are filled with a liquid.

9. A method for establishing a temporary fluid storage facility for a well completion comprising the steps of:

(a) towing a barge and tank storage assembly and caisson to a caisson well completion site;

(b) submerging said storage assembly and said caisson at said site;

(c) displacing all gas in said assembly with liquid;

(d) displacing liquid in said storage assembly with liquid produced from said well completion; and (e) collecting liquid displaced from said storage assembly in a surface transport vessel.

10. The method as defined in claim 9, further comprising the step of at least partially structurally supporting said caisson in a caisson well completion with said storage assembly.

11. The method as defined in claim 9, further comprising the step of towing said caisson to said site by said barge and tank storage facility.

12. The method as defined in claim 10 wherein the barge in said barge and tank storage assembly is constructed primarily of concrete.

13. The method as defined in claim 10, further comprising the step of towing said caisson to said site by said barge and tank storage facility.

14. The method as defined in claim 9 wherein the barge in said barge and tank storage assembly is constructed primarily of concrete.

15. The method as defined in claim 14 wherein the tank in said barge and tank storage assembly includes one or more steel tanks encased in concrete.

* * * * *